US006574894B1

(12) United States Patent
Hamilton

(10) Patent No.: US 6,574,894 B1
(45) Date of Patent: Jun. 10, 2003

(54) FRAMED CALENDAR HOLDER

(76) Inventor: Daniel H. Hamilton, 908 Mills St. 839-1208, Raleigh, NC (US) 27608

( * ) Notice: Subject to any disclaimer, the term of this patent is extended or adjusted under 35 U.S.C. 154(b) by 0 days.

(21) Appl. No.: 09/939,280

(22) Filed: Aug. 27, 2001

(51) Int. Cl.[7] ..... G09D 3/00
(52) U.S. Cl. ..... 40/107; 40/120; 283/2
(58) Field of Search ..... 40/107, 120, 119; 283/2

(56) References Cited

U.S. PATENT DOCUMENTS 209,577 A * 11/1878 Meineke ..... 40/121
526,397 A * 9/1894 Kinnard ..... 40/121
3,525,170 A * 8/1970 Greenberg ..... 40/121
4,877,213 A * 10/1989 Lambert ..... 40/790
6,182,938 B1 * 2/2001 Wright ..... 40/617
6,253,473 B1 * 7/2001 Collins ..... 40/120
6,345,456 B1 * 2/2002 Bracken ..... 40/120

* cited by examiner

*Primary Examiner*—Cassandra H. Davis
(74) *Attorney, Agent, or Firm*—Mills Law Firm PLLC

(57) ABSTRACT

A calendar holder for dual panel folding calendars includes a peripheral frame for receiving the calendar, a lower slot for supporting the bottom calendar panels, an upper slot for supporting the upper calendar panels, and a mounting peg at the upper slot that extends through perforations in the upper panels to independently hang the calendar within the frame.

3 Claims, 5 Drawing Sheets

FRAMED CALENDAR HOLDER

FIELD OF THE INVENTION

The present invention relates to devices for holding calendars, and, in particular, a holding frame for displaying and hanging preprinted calendars in a bifold format.

BACKGROUND OF THE INVENTION

Yearly, monthly and weekly calendars are widely available in varying formats for use on desks, walls, refrigerators and other venues for tracking dates and activities. On walls, the calendars are generally hung from an exposed picture hook or nail. Such a stark presentation detracts from the visual quality of the calendar and from framed paintings or photographs, and wall hangings in accompanying spaces.

To provide additional decor, various holding devices have been proposed for holding and framing calendars. For instance, U.S. Pat. No. 1,765,070 to Graham provides a picture frame for a calendar wherein a bottom slot in the rear of the frame allows substitute calendar pages to be inserted. The frame is limited to a single panel display and must be removed from the wall for changing the display. Other calendar frames have been limited to designs specifically tailored to the frame such as shown in U.S. Des. Pat. Nos. 425,114 and 423,571 to Blazer et al., and 318,292 to Duncan wherein the calendar pages are inserted by removing a rear panel of the frame. Calendar frames have also been proposed wherein date information may be entered on a clear cover panel overlying the calendar, as disclosed in U.S. Pat. No. 4,852,282 to Selman, allowing successive months to be displayed without changing a calendar template. Thus, the use of the calendar frames is limited to specifically designed formats and not amenable to commercially available merchandise.

One popular calendar type widely available to consumers comprises a plurality of sheets that are hinged at a center horizontal fold by staples, spiral springs or like connections, thereby dividing the calendar into an upper panel generally bearing a thematic photographic or artistic rendering, and a bottom panel with conventional grids displaying the date, day and month. By pivoting the lower panel upwardly, successive months and renderings may be displayed. The panels are provided with central perforations at their upper margins to allow the calendar to be hung and displayed from a suitable fastening member such as a picture hook. While displaying appealing artistry and quality and easily changed from month to month, the intended picture hook mounting detracts from the presentation.

SUMMARY OF THE INVENTION

The present invention provides a decorative framed calendar holder that may be fashioned in a wide variety of frame molding materials and configurations, readily accepts conventional sized bifold or folding calendars, and may be update without removing any component while remaining in the hung position on a wall. The calendar holder includes a peripheral frame that conformably receives a conventional bifold calendar. A lower cross member at the bottom molding provides a lower slot for receiving the lower panels of the calendar. An upper cross member at the top molding provides an upper slot for receiving the upper panels of the calendar. The upper cross member carries a sliding mounting peg that extends through the perforations in the upper panels thereby independently hanging the calendar within the calendar holder. The calendar may be changed by slightly bowing the lower panel and removing it from the lower slot, flipping the removed lower panel upwardly, retracting the mounting peg, bowing the panel into the upper slot, and reinserting the mounting peg to re-hang the calendar on the frame with the new month and artistry displayed.

Accordingly, it is an object of the present invention to provide a calendar holder that is available in a wide variety of decorative framing materials.

Another object of the invention is to provide a hanging holder for a calendar that may changed for succeeding months without removal from the support surface.

A further object of the invention is to provide a decorative calendar holder for widely available calendar formats.

Yet another object of the invention is to provide a calendar holder for multiple panel calendars that may be changed monthly without the removal of framing components.

DESCRIPTION OF THE DRAWINGS

The above and other objects and advantages of the present invention will become apparent upon reading the following detailed description taken in conjunction with the accompanying drawings in which.

DETAILED DESCRIPTION OF THE PREFERRED EMBODIMENTS

Figure 1:
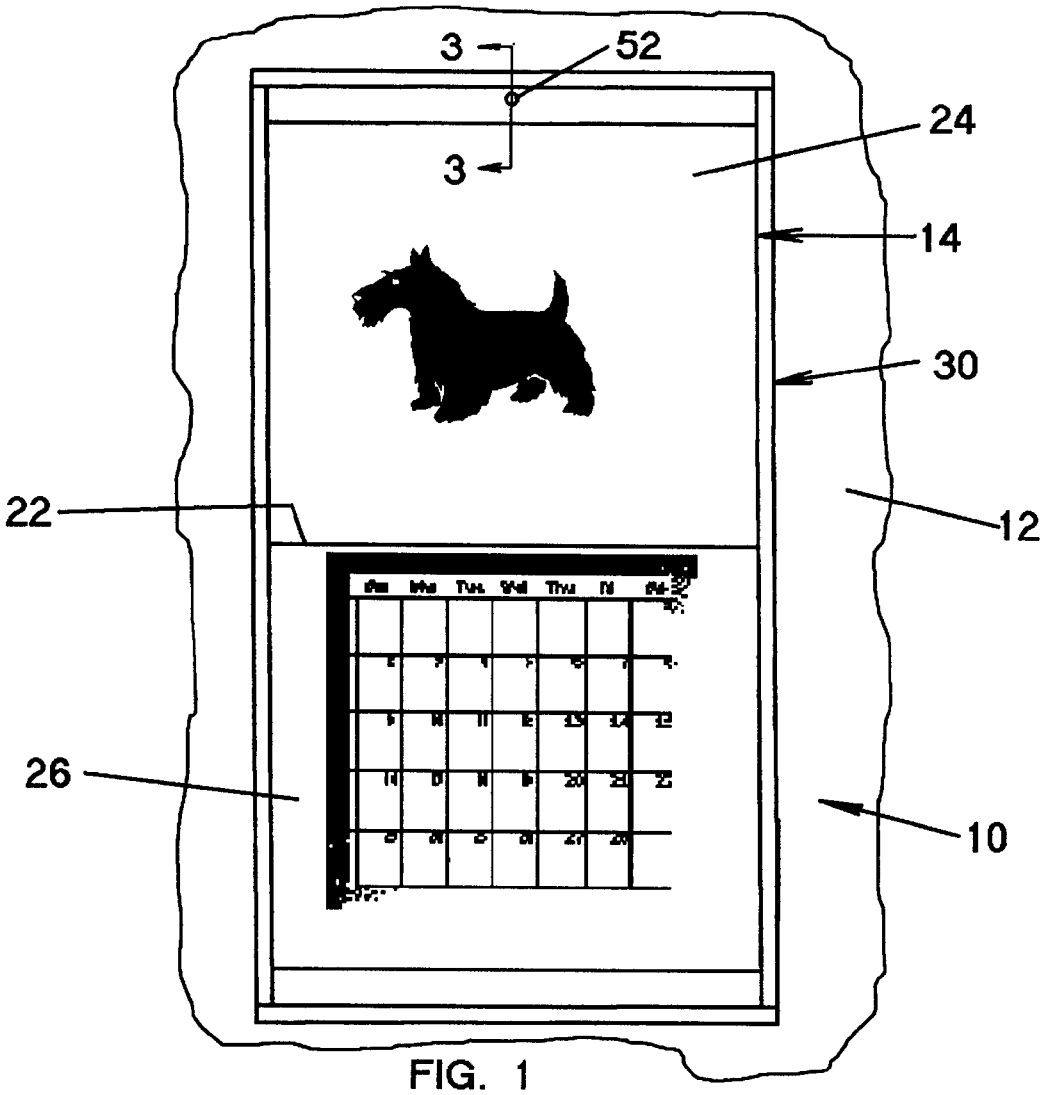
FIG. 1 is a front elevational view of a calendar holder carrying a calendar.
Figure 2:
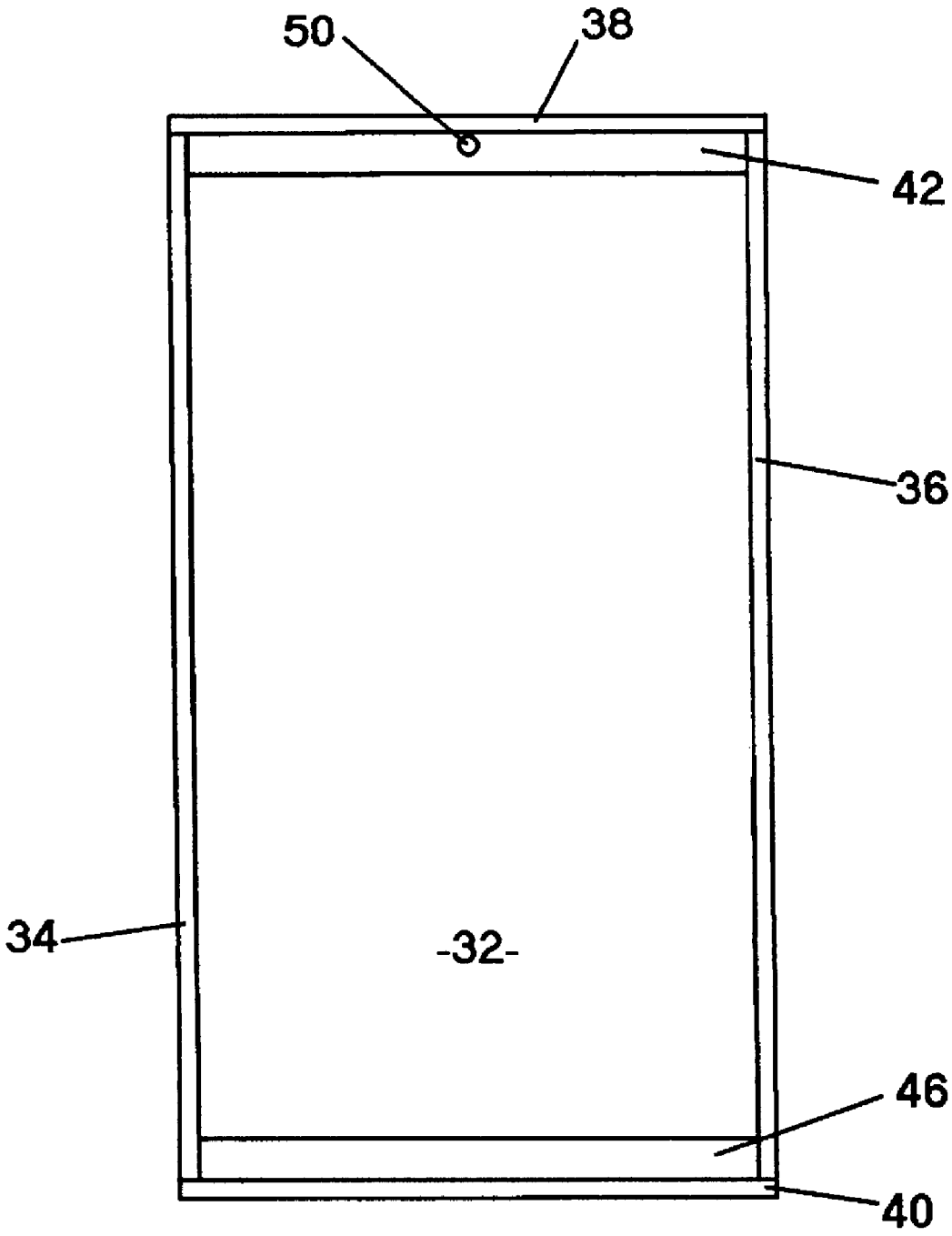
FIG. 2 is a front elevational view of the calendar holder shown in FIG. 1 with the calendar removed.
Figure 5:
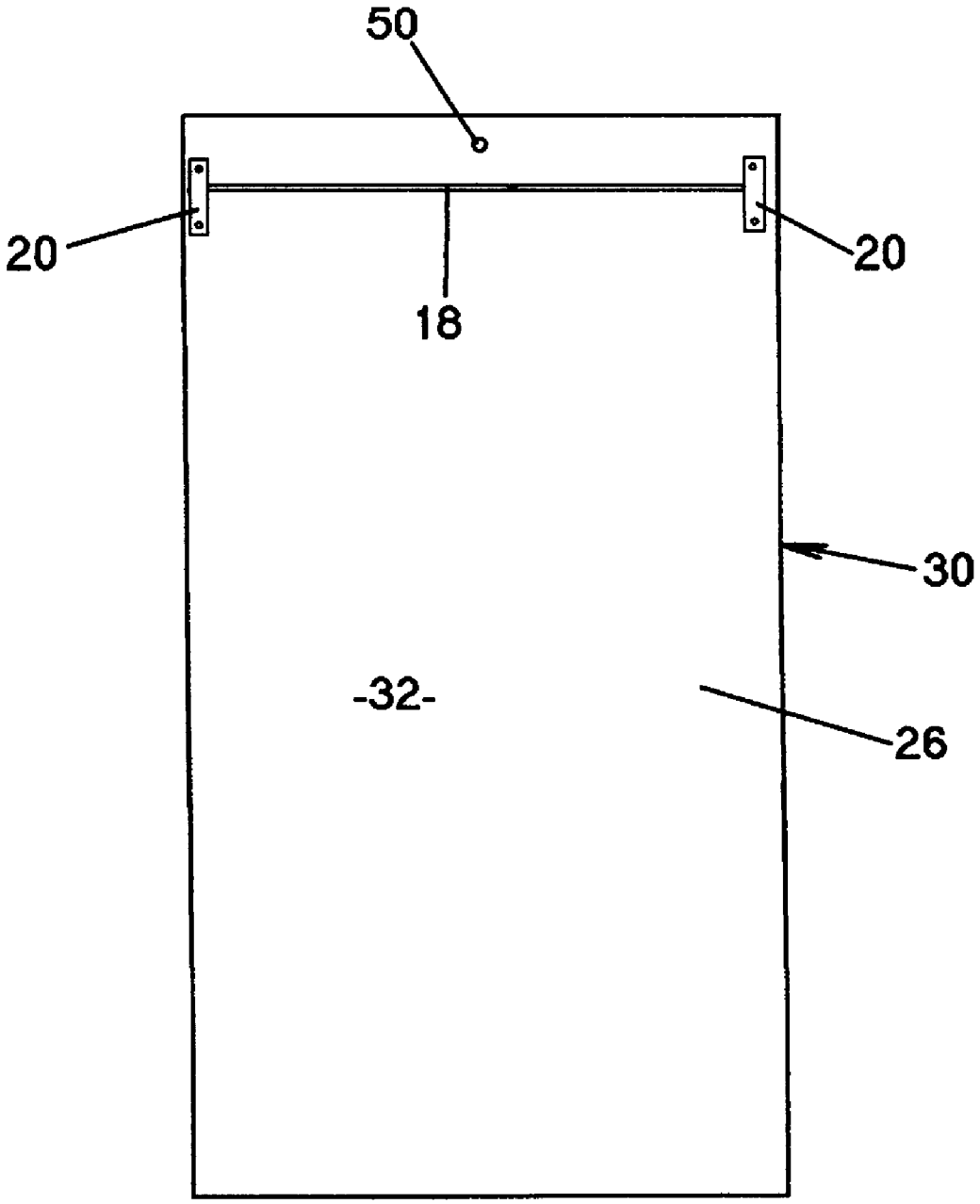
FIG. 5 is a rear view of the calendar holder.
Figure 6:
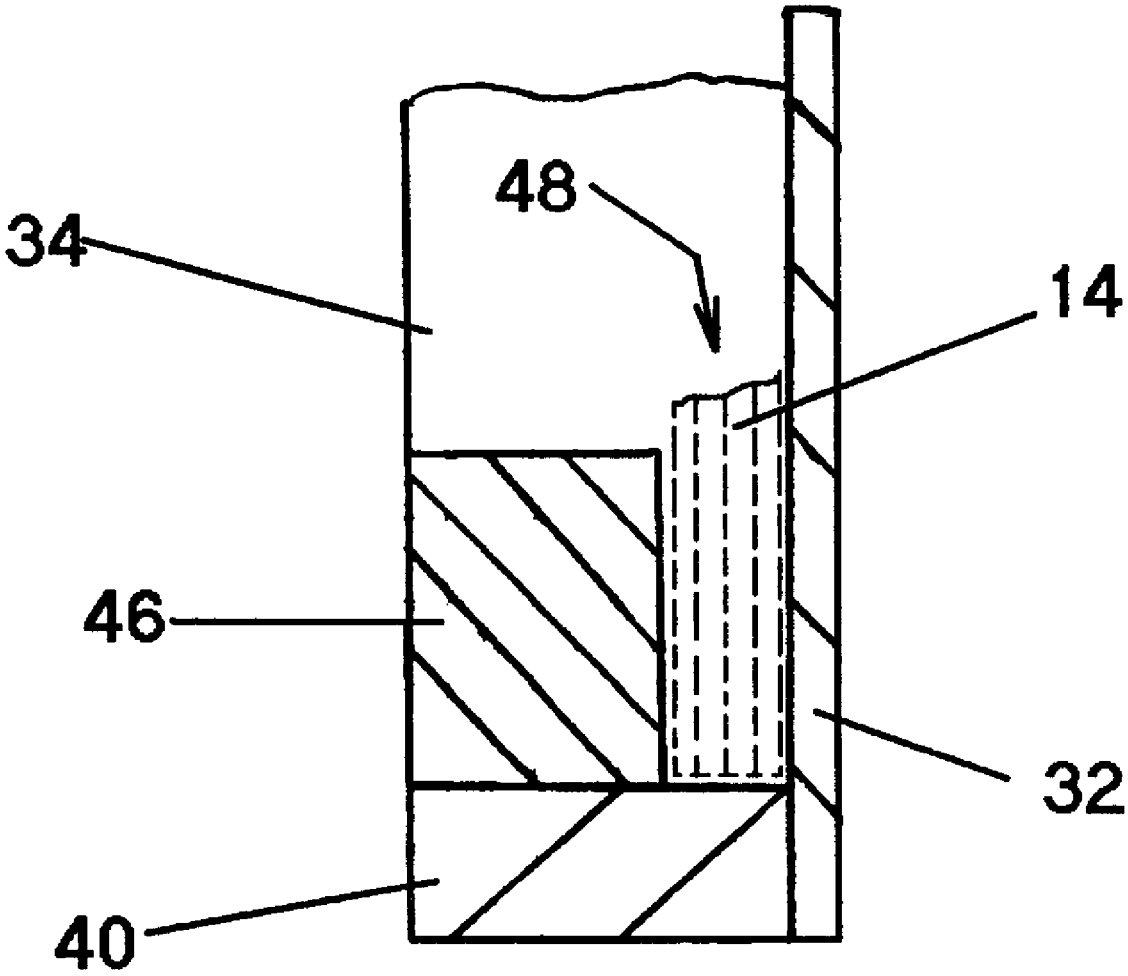
FIG. 6 is an enlarged fragmentary cross sectional view taken along line 6—6 in FIG. 1.

Referring to the drawings for the purpose of describing the preferred embodiment and not for limiting same, FIG. 1 illustrates a calendar holder 10 mounted on a vertical wall 12 and carrying thereon a conventional folding calendar 14. As shown in FIG. 5, the rear surface 16 of the holder 10 is provided with a suitable hanger 18, such as a horizontal picture wire, attached to side brackets 20 for mounting the calendar on the wall 12.

Figure 3:
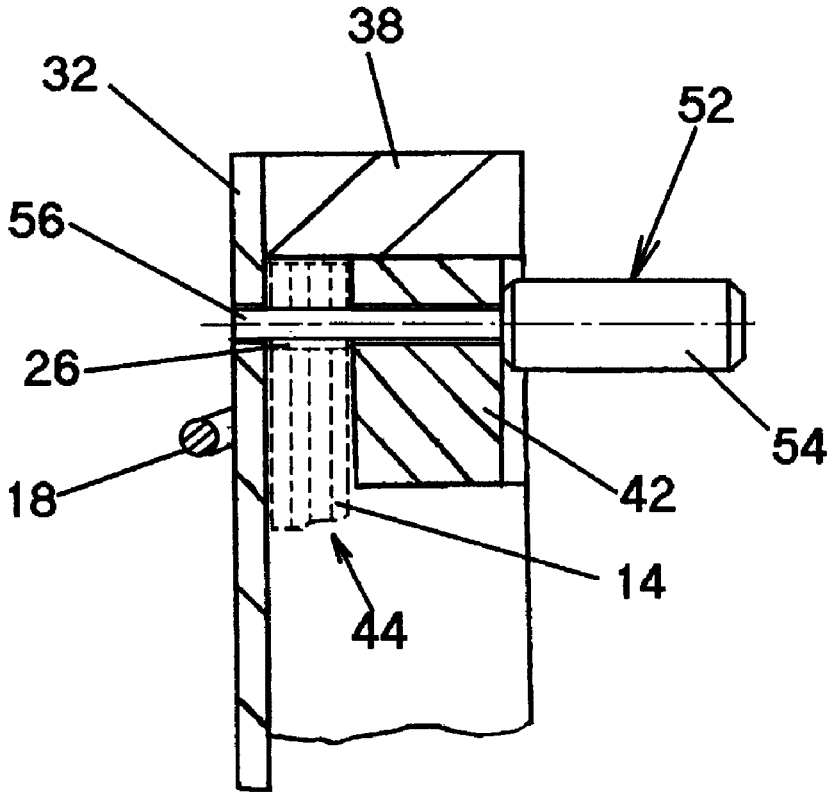
FIG. 3 is an enlarged cross sectional view taken along line 3—3 in FIG. 1.
Figure 4:
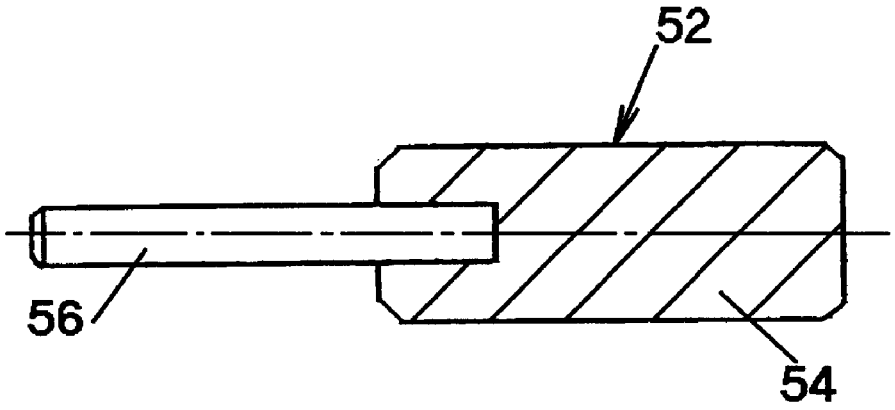
FIG. 4 is a cross sectional view of the mounting peg for the calendar holder.

The calendar 14 is a conventional folding calendar comprising a plurality of stacked sheets, printed on both sides and connected together by staples, spiral binders and the like at a horizontal centerline 22 to divide the displayed calendar format into an upper panel 24 and a lower panel 26. One of the panels, generally the lower panel 24 depicts monthly dates by month, date and day in conventional fashion. The other panel, generally the upper panel 22 displays a rendering in the form of a photograph, print or other media presentation. By selectively rotating the panels into a common plane, an annual calendar may be selected on a month-by-month or other periodic basis. To enable the calendar to be hung from a suitable anchor such as a picture hook, the panels 24, 26 include, as shown in FIG. 3, perforated, aligned holes 26, horizontally centered and spaced slightly inwardly of the vertical ends of the panels.

A widely available folding calendar of the type beneficially used in the present invention measures, in displayed form, about 24 inches high and 12 inches wide with the centerline 22 dividing the calendar into panels of about 12 inches high and 12 inches wide. The calendar comprises at least twelve sheets of stock, printed on both sides, thereby displaying a calendar year of dates and display panels.

Referring additionally to FIGS. 2 through 4 and 6, the calendar holder 10 includes a frame 30 and a base plate 32. The frame member 30 includes laterally spaced, vertical side moldings 34, 36, and longitudinally spaced, horizontal top and bottom moldings 38, 40, respectively. The side moldings 34, 36 have a lateral spacing for receiving and having a slight clearance relationship with the width of the calendar, preferably about 12-1/16 inch. The top molding 38 and the bottom molding 40 have a longitudinal spacing for receiving with a slight clearance relationship with the height of the calendar, preferably about 24-1/32 inch. An upper header 42 abuts the upper molding 38 and extends between the side rails 34, 36. The upper header 42 is spaced forwardly of the base plate 32 defining a downwardly opening slot 44. A lower footer 46 abuts the bottom molding 40 and extends between the side moldings 34, 36. The lower footer 46 is spaced forwardly of the base plate 32 defining a upwardly opening slot 48. The slots 48, 44 are sufficiently wide to accept the stacked thickness of the panels for the calendar at each of the monthly orientations. The slots 44, 48 preferably have a width of about ¼ inch to ½ inch.

The moldings and the header and footer may be formed of any suitable material of desired exterior cross sectional configuration and joined together at butt or miter joints in a conventional manner.

The header 42 and base plate 32 includes a through hole 50 that slidably receives a mounting peg 52. The hole 50 is horizontally centered and located slightly below the upper molding 38 in a location that is aligned with the perforated holes 26 in the calendar panels. The mounting peg 52 comprises an enlarged cylindrical head 54 and a smaller cylindrical shank 56 that is slidably received in the hole 50. The shank 56 has an inner end carried in a counterbore in the head 54 and connected thereto by an adhesive and/or interference fit. The head 54 has a size that is comfortably grasped by a user, generally about ¼ inch to ½ inch in diameter.

In use, the holder 10 is appropriately hung on the wall 12 and the calendar 14 inserted therein between the moldings with the upper and lower ends carried in the slots 48, 44. The calendar panels 24, 26 are selectively folded to display the desired upper and lower panels. With the calendar lightly pressed against the back plate, the mounting peg 52 is inserted into the hole 50 in the header 42, through the aligned holes 26 in the upper panels, and through the corresponding hole in the base plate 32. Thereafter, the calendar will be independently hung by the upper panels on the mounting peg 52 for display. To change the display, the next lower panel is Ad bowed outwardly to clear the slot 48 in the footer 46 and pivoted upwardly about the center line 22, bowed to allow the upper end to enter the slot 44, aligned with the other upper panels, and the mounting peg 52 reinserted to capture the upper panels and display the contents, dates and renderings, of the succeeding month.

It will thus be appreciated that the present invention permits to user to select a decorative calendar frame of desired construction for hanging at a desired location and, without removing any component or the frame from the wall and thereafter quickly and conveniently change the calendar display in accordance with the current date.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the spirit and scope of the present invention. The disclosures and description herein are intended to be illustrative and are not in any sense limiting of the invention, which is defined solely in accordance with the following claims.

What is claimed:

1. A calendar holder for framing a dual panel calendar of the type having a plurality of panels hingedly interconnect and displaying a calendar format including an upper panel and a lower panel wherein said panels have apertures establishing aligned mounting openings at said upper panels in the calendar format, said calendar holder comprising: a frame member defining an opening for receiving an upper panel and a lower panel in the calendar format; a base plate connected to rear surfaces of said framing member; a first cross member extending between the side of said frame member and defining with said base plate a first slot means for slidably receiving lower ends of said lower panels; a second cross member extending between the sides of said frame member and defining with said base plate a second slot means for slidably receiving upper ends of said upper panels: a and mounting means associated with said second slot means for extending through said aligned openings in said upper panels to independently, suspend the calendar within said frame member wherein said mounting means includes a mounting opening extending through said second cross member and aligned with the openings in said upper panel, and pin means slidably carried in said mounting opening and having a first position permitting entry of said upper panels into said second slot means and a second position extending through said openings in said upper panels thereby suspending the calendar within said frame member.

2. The calendar holder as recited in claim 1 wherein said mounting opening extends through said second cross member and said base member.

3. The calendar holder as recited in claim 2 wherein said pin means includes a circular shank slidably carried in said mounting opening and an enlarge handle attached to said shank and engaging said second cross member in said second position.

* * * * *